US007055807B2

(12) United States Patent
Pesta

(10) Patent No.: US 7,055,807 B2
(45) Date of Patent: Jun. 6, 2006

(54) EXPANDABLE POLE SOCKET WITH TWIST AND LOCK INSERT

(75) Inventor: LeeAnn Pesta, Hauppauge, NY (US)

(73) Assignee: Pool Cover Corporation, Hauppauge, NY (US)

( * ) Notice: Subject to any disclaimer, the term of this patent is extended or adjusted under 35 U.S.C. 154(b) by 0 days.

(21) Appl. No.: 10/876,936

(22) Filed: Jun. 25, 2004

(65) Prior Publication Data

US 2005/0285092 A1 Dec. 29, 2005

(51) Int. Cl.
*E04H 17/22* (2006.01)

(52) U.S. Cl. ..... 256/65.14; 256/1; 256/24; 160/351; 248/530; 248/156; 52/170; 52/297; 52/298

(58) Field of Classification Search ..... 256/1, 256/19, 21, 24, 25, 65.14; 160/351; 248/530, 248/545, 156; 52/170, 296, 297, 298; 403/348, 403/350, 365, 367

See application file for complete search history.

(56) References Cited

U.S. PATENT DOCUMENTS

| | | | | |
|---|---|---|---|---|
| 202,179 | A | 4/1878 | Lennon | |
| 529,067 | A | 11/1894 | Fraser | |
| 978,505 | A | 12/1910 | Stewart | |
| 1,224,926 | A | 5/1917 | Hindmarsh | |
| 1,263,132 | A | 4/1918 | Sharpe | |
| 1,419,108 | A | 6/1922 | Bitting | |
| 1,582,454 | A | 4/1926 | Evans | |
| 2,889,614 | A | 6/1959 | Seely | 29/155 |
| 3,093,363 | A | 6/1963 | Bohon | 256/26 |
| 3,159,248 | A | 12/1964 | Biehn | 189/31 |
| 3,272,061 | A | 9/1966 | Seckerson | 85/82 |
| 3,385,565 | A * | 5/1968 | Cuthbert | 52/297 |
| 3,433,119 | A * | 3/1969 | Ballantyne et al. | 411/437 |
| 3,612,287 | A * | 10/1971 | Maltese | 52/297 |
| 3,894,589 | A | 7/1975 | Ciraud | 175/23 |
| 4,000,585 | A | 1/1977 | Denaro | 52/2 |
| 4,007,516 | A | 2/1977 | Coules | 24/221 |
| 4,614,471 | A | 9/1986 | Mauritz | 411/21 |
| 4,649,678 | A | 3/1987 | Lamson | 52/103 |
| 4,787,601 | A | 11/1988 | Rybak | 256/19 |
| 5,094,148 | A * | 3/1992 | Haber et al. | 403/348 |
| 5,553,833 | A | 9/1996 | Bohen | 256/65 |
| 5,586,364 | A | 12/1996 | Ferrari et al. | 16/383 |
| 5,625,988 | A * | 5/1997 | Killick | 52/298 |
| 6,123,321 | A | 9/2000 | Miller | 256/25 |
| 6,679,662 | B1 | 1/2004 | Nehl | 411/80.5 |

* cited by examiner

*Primary Examiner*—Daniel P. Stodola
*Assistant Examiner*—Michael P. Ferguson
(74) *Attorney, Agent, or Firm*—Alfred M. Walker

(57) ABSTRACT

An expandable socket holds a fence pole for a flexible swimming pool fence. The socket, being generally cylindrical, but slightly tapered, is open at a top end and has a bottom end partially closed with a rectangular opening. The socket sits within a bore within a concrete swimming pool deck or within a cylindrical sleeve adapted to be imbedded in a hole in earth. The lower end of the fence pole has a shaft, with a locking plate mounted thereon. The locking plate fits through the opening in the socket and is twisted to lock the pole in place within the socket. The socket has one or more lengthwise expansion ribs extending from a sidewall. Each rib is capable of limited pivotal outwardly and inwardly movement and has an increased taper at the distal end. When the fence pole is inserted into the socket, each rib is forced outwardly to engage an inner surface of the cylindrical sleeve.

9 Claims, 4 Drawing Sheets

EXPANDABLE POLE SOCKET WITH TWIST AND LOCK INSERT

FIELD OF THE INVENTION

The present invention relates to safety locks for fence posts of fences for swimming pools.

BACKGROUND OF THE INVENTION

Flexible fences are known, to provide an extra measure of protection in addition to typical chain link fences around a swimming pool, which can sometimes to climbed by young children. The flexible fences are too loose for gripping, and therefore prevent a young child from getting unsupervised access to a swimming pool, even if the child climbs over a conventional chain link fence around a swimming pool. Such flexible fences are described in U.S. Pat. No. 5,553,833 of Bohen.

In addition, there are fence plugs with expandable wings of sockets for fence poles, such as disclosed in U.S. Pat. No. 978,505 of Stewart or U.S. Pat. No. 3,159,248 of Biehn. Also quarter turn twist lock posts for fences are described in U.S. Pat. No. 4,007,516 of Coules.

U.S. Pat. No. 4,787,601 of Rybek shows plastic anchor sockets, but they are not expanding.

OBJECTS OF THE INVENTION

It is therefore an object of the present invention to provide child-resistant socket and post assembly for a temporary flexible fence post.

SUMMARY OF THE INVENTION

A low fence of screen netting is sometimes used as a barrier around a pool to deny access to infants and toddlers. Generally support poles are used which are inserted into permanent holes around the pool to provide a means to erect and take down this temporary fencing as needed. Two considerations in this apparatus are safety and convenience. The fence should be easy to erect and remove while making it difficult for a small child to pull the poles from the holes. A simple locking means, such as a twist lock, is sometimes used to satisfy these two considerations.

This invention provides a twist and lock pole insertion and removal capability. In addition, the initial hole preparation which involves insertion of a pole socket is especially simple with the present invention since no great exertion or tools are required. Since the pole socket and the twist and lock insert which is attached to the pole bottom are injection molded from a plastic resin such as polypropylene, low cost and long corrosion resistance are assured. No moving parts or auxiliary metal elements are required. The lock is positively initiated by a twist motion ranging anywhere from about 30 to 90 degrees after the pole is seated in the pole socket.

The pole socket is a hollow cylindrical shape that is slightly tapered from top to its bottom which has a rectangular keyway cutout. Each socket includes one or more (preferably three) of elongated expansion ribs flexibly attached at their upper ends to the walls of the socket. The ribs have a crossectional shape that increases in thickness toward the bottom of the socket, so that the ribs expand outward to engage the sides of the hole when a pole is inserted.

The twist and lock insert which is attached to the bottom of each pole has a shaft region which is inserted into the pole end as well as a small rectangular plate, smaller in both dimensions than the rectangular cutout at the bottom of the pole socket. The insert is inserted into the pole end leaving some space between the pole end and the distal plate. By rectangular it is assumed that the plate has a shape with two axes, where one axis is longer than the other axis. Therefore the plate can also be rounded and elliptical, as well as rectangular.

Operation involves simply inserting the pole into the expandable pole socket and rotating slightly until the distal plate goes through the keyway cutout at the bottom of the pole socket. A twist of the pole beyond this orientation locks the pole to the pole socket.

There is great resistance to pull out the pole and pole socket from the hole in this position beyond the slight press fit of the top region of the pole socket into the hole. This is because the expandable ribs have been pushed with some force against the side walls of the hole.

By twisting the smooth pole back into registration between distal locking plate and rectangular keyway at the bottom of the socket, it can be easily withdrawn with an upward force. This releases the force of the ribs against the hole wall sides, but the slight press fit of the socket in the hole is enough to ensure retention of the pole socket in the hole while the smooth outer surface of the pole easily moves upward disengaging with the expandable ribs.

With the pole sockets of this invention, hole preparation simply involves pressing in a pole socket into a rigid hole until it seats to its upper collar. The press fit force is not relied upon to keep the socket from being pulled up when the pole is locked, so this can be light fit. It is the force of the expandable ribs against the hole walls that serve this purpose while the side force of each rib against the pole side keeps it centered and upright. It is also the rib force against the hole wall that permits the pole to be rotated while the socket remains stationary.

It can be appreciated that the pole should be of smooth surface such as aluminum tubing or plastic resin. In concrete, the pole sockets can be used directly in bored holes. In soft ground, a rigid cylindrical sleeve must be used as a hole liner; this can be a section of metal or plastic pipe of appropriate inner diameter.

BRIEF DESCRIPTION OF THE DRAWINGS

The present invention can best be understood in connection with the accompanying drawings, in which.

DETAILED DESCRIPTION OF THE INVENTION

Figure 1:
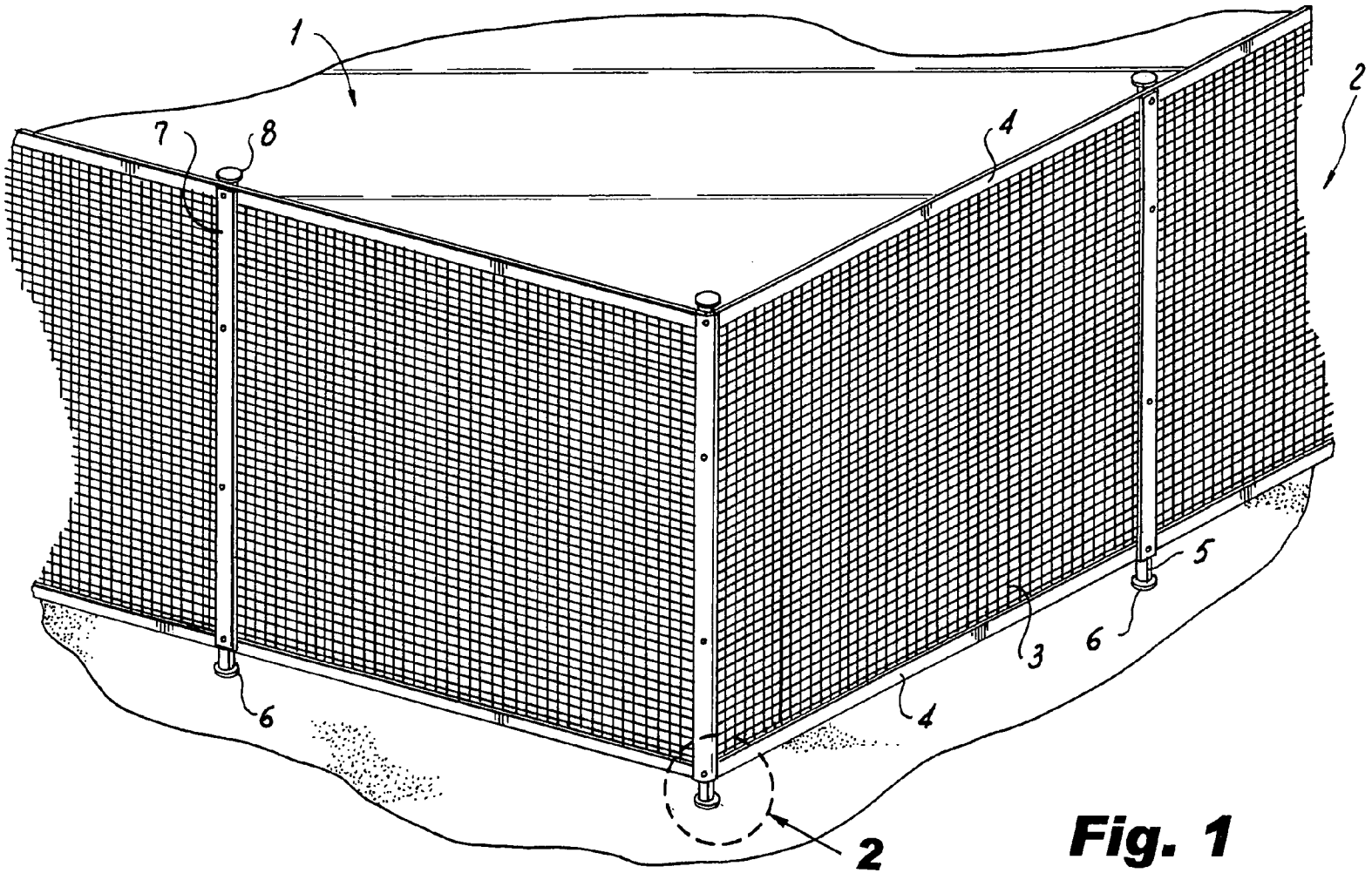
FIG. 1 is a Perspective detail of temporary fencing around a pool.

FIG. 1 shows pool 1 with a section of temporary fencing 2. Fence 2 material consists of plastic netting 3 which is more secure than a low section of chain link fencing since is not graspable and less prone to injury of infants and toddlers. This netting has reinforcing fabric webbing 4 on top and bottom edges. Upright support poles 5 are inserted into permanent holes 6 around pool 1 periphery. Screwed plates 7 attach netting 3 to poles 5.

Figure 2:
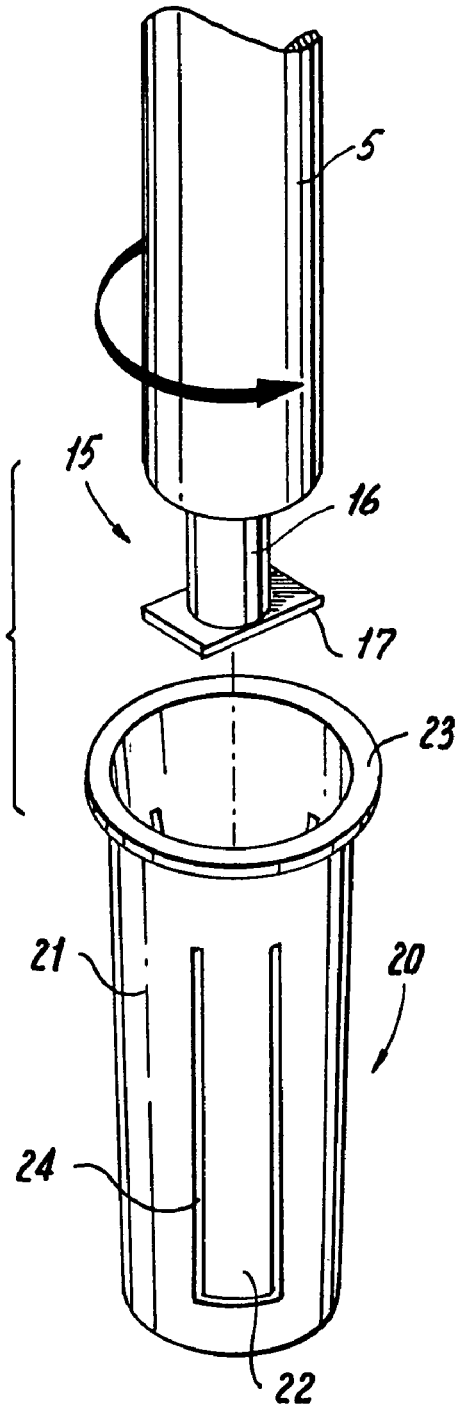
FIG. 2 is a Perspective view of the major components of the expandable pole socket and twist and lock insert of this invention.

FIG. 2 shows the major components of this invention. Pole 5 has a twist and lock insert 15 attached to its bottom end via shaft 16. Rectangular locking plate 17 is at its distal end. Expandable pole socket 20 is shown with collar 23, slightly tapered side 21 and locking rib 22 which is attached at its upper end but free along sides and distal end. Space 24 which permits free movement in and out.

Figure 3:
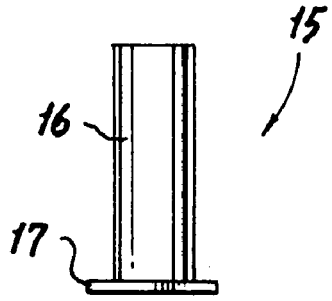
FIG. 3 is a Side elevational view of a twist and lock insert used with the temporary fencing of FIGS. 1 and 2.
Figure 4:
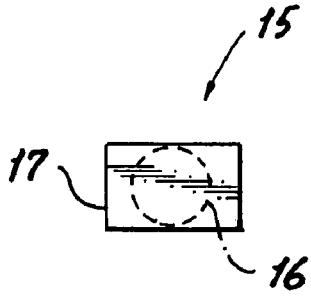
FIG. 4 is a Bottom view of the twist and lock insert of FIG. 3.

FIGS. 3 and 4 show the side and bottom views respectively of twist and lock insert 15.

Figure 5:
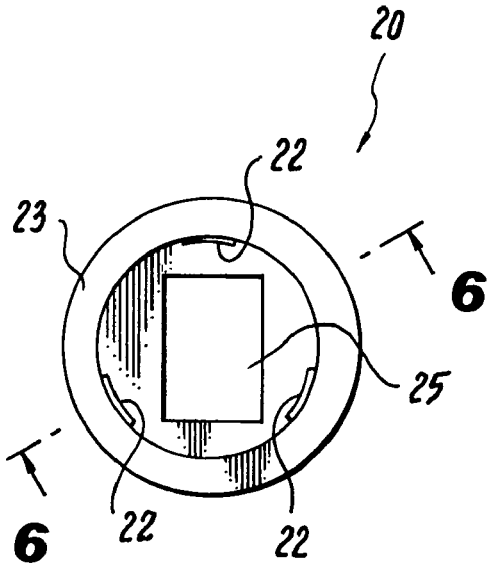
FIG. 5 is a Top plan view of an expandable pole socket used with the temporary fencing of FIG. 1.

FIG. 5 is a top view expandable pole socket 20 showing three locking ribs 22 spaced at 120 degree intervals with rectangular locking keyway 25 at the bottom.

Figure 6:
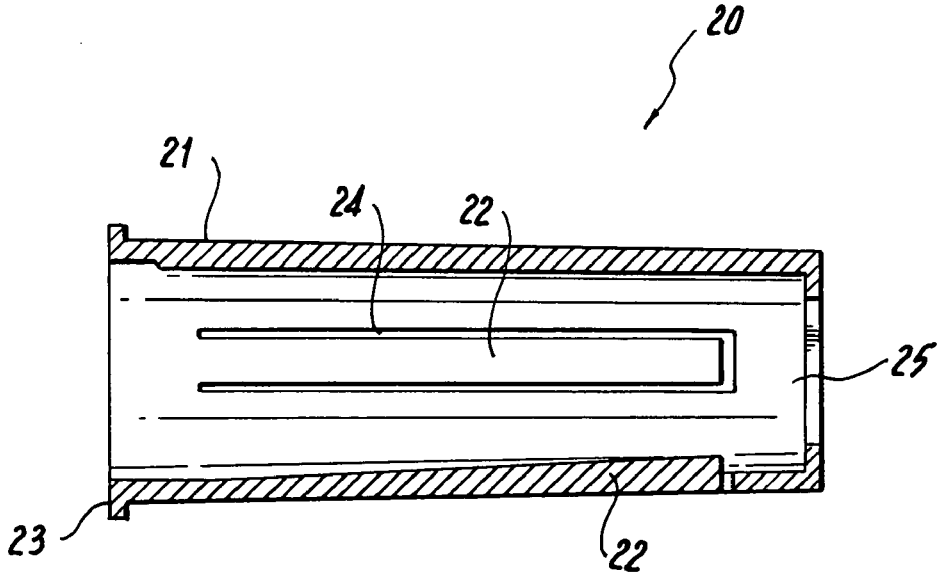
FIG. 6 is a Crossectional side view of the expandable pole socket as in FIG. 5.

FIG. 6 is a side view crossection of expandable pole socket 20 with one locking rib 22 (on bottom of figure) shown in crossection. It is tapered to a thicker crossection at its distal end.

Figure 7:
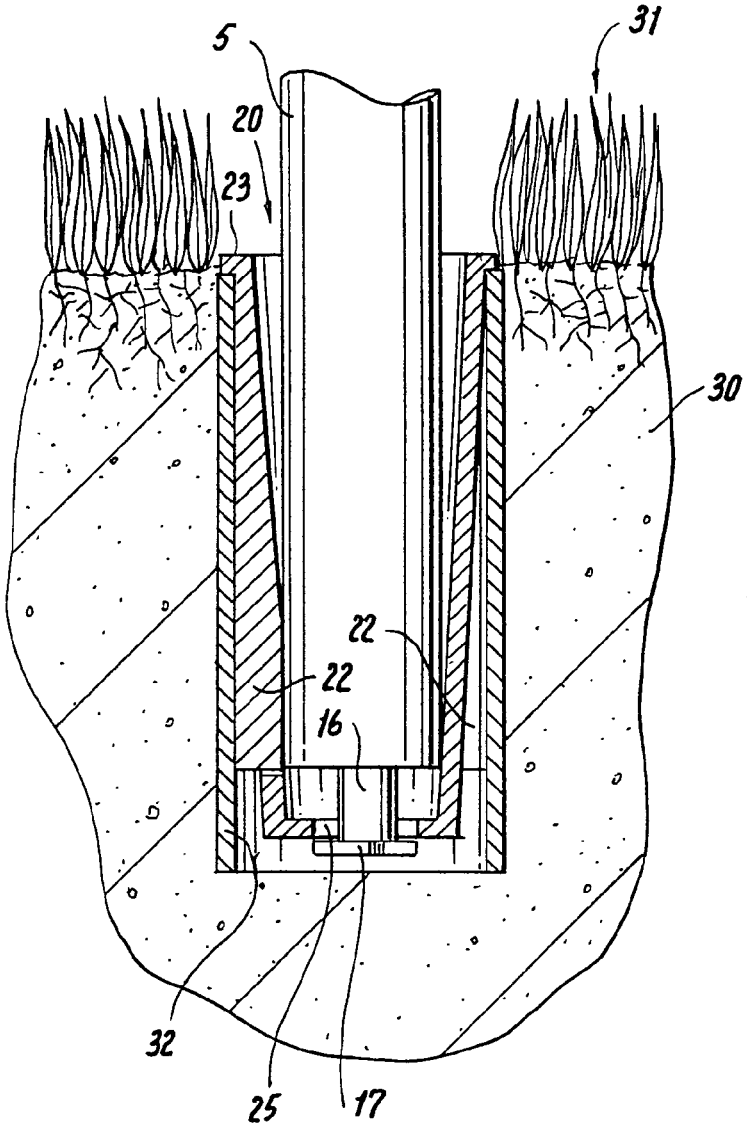
FIG. 7 is a Side elevational view in partial crossection of the pole of FIGS. 1 and 2, shown locked into an expandable pole socket in a soft ground installation; and, FIG. 8 is a Side elevational view detail view, showing a cap used to cover open tops of expandable pole socket for the off-season.

FIG. 7 shows a side view of a locked pole 5 in partial crossection in a soft ground 30 installation in a lawn area with grass 31. Rigid metal pipe 32 is installed in a hole. Expandable pole socket 20 is shown in crossection (similar to FIG. 6) in such a view as to show the intimate engagement of rib 22 with the side of pipe 32 when pole 5 is inserted and locked. Plate 17 has been inserted through opening 25 and twisted out of alignment.

Figure 8:
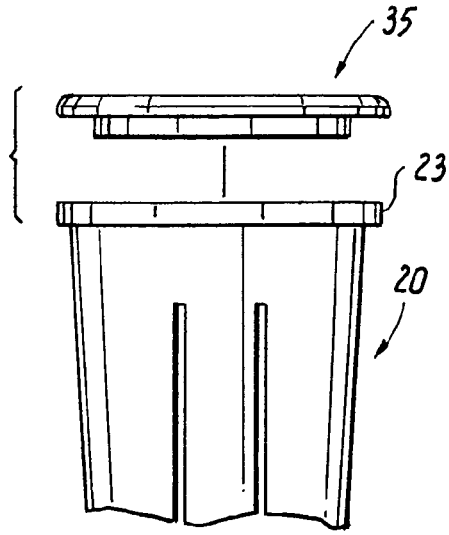

FIG. 8 shows accessory cap 35 which is sized to fit the top opening of expandable pole socket 20. This is used in the off season, such as winter in the northeast, to seal socket 20 from water and debris.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended claims.

I claim:

1. An expandable socket in combination with a fence pole comprising:

said socket being cylindrical, open at a top end and having a bottom end partially closed with an opening having a pair of axes wherein one axis is longer than the other axis;

a cylindrical member adapted to be imbedded in a hole in earth and sized to receive said socket;

said fence pole having a lower end for insertion into said socket when fitted into said cylindrical member;

the lower end of said fence pole having a shaft extending therefrom;

a locking plate mounted on a bottom of said shaft in a plane at right angles to a central axis of said shaft, said locking plate having a planar shape with two axes, where one axis is longer than the other axis, said locking plate being sized to fit through the opening in said socket, when said fence pole is in one rotational position and said locking plate being blocked from passing through said opening when turned into another rotational position, so that when said fence pole is inserted into said socket and said locking plate is passed through said opening followed by rotating said fence pole, said fence pole is fixed in place is said cylindrical member by said socket;

said socket having at least one lengthwise expansion rib in a sidewall formed by a pair of parallel slits in said sidewall and a slit adjacent the lower end of said cylindrical member at right angles to said parallel slits so that said rib is flexibly attached at an upper end to said cylindrical member and said rib is capable of limited outwardly and inwardly movement about the upper end of said rib; and said rib having a thickness which changes from the same thickness of the sidewall of said socket where said rib attaches to said sidewall to a greater thickness at a bottom end of said rib, whereby when said fence pole is inserted into said socket said rib is forced outwardly to engage an inner surface of said cylindrical member.

2. The expandable socket and fence pole of claim 1 in which said socket tapers inwardly from said top end to said bottom end of said socket.

3. The expandable socket and fence pole of claim 2 in which the top end of said socket has a flange to engage a top end of said cylindrical member.

4. The expandable socket and fence pole of claim 3 in which the bottom end of said socket is above a bottom end of said cylindrical member when fully inserted into said cylindrical member leaving a space above a bottom of said hole in the earth for accommodating said locking plate when the fence pole is locked into said socket.

5. The expandable socket and fence pole of claim 4 in which said fence pole is removable from said socket by rotating said fence pole to a position where said locking plate will pass through said opening.

6. The expandable socket and fence pole of claim 5 in which there are at least three of said ribs in the sidewall of said socket.

7. The expandable socket and fence pole of claim 6 in which said socket is made from injection molded plastic resin.

8. The expandable socket and fence pole of claim 1 wherein said opening and said locking plate are rectangular.

9. The expandable socket and fence pole of claim 1 wherein said opening and said locking plate are elliptical.

* * * * *